US005772497A

United States Patent [19]

Dummermuth

[11] Patent Number: 5,772,497

[45] Date of Patent: Jun. 30, 1998

[54] MOVABLE SURFACE TREATMENT DEVICE

[75] Inventor: Paul Dummermuth, Zunzgen, Switzerland

[73] Assignee: Pamag AG, Switzerland

[21] Appl. No.: 712,124

[22] Filed: Sep. 11, 1996

[51] Int. Cl.[6] ..... B24B 23/03

[52] U.S. Cl. ..... 451/350; 451/352; 299/39.2; 299/40.1

[58] Field of Search ..... 451/350, 352, 451/358, 211; 299/40.1, 39.9, 39.1, 39.2, 39.6

[56] References Cited

U.S. PATENT DOCUMENTS

| | | | |
|---|---|---|---|
| 0,939,373 | 11/1909 | Allen | 451/352 |
| 1,084,810 | 1/1914 | Messer | 299/39.9 |
| 2,898,826 | 8/1959 | Livermont | 451/350 |
| 4,155,596 | 5/1979 | Brejcha | 299/40.1 |
| 4,634,188 | 1/1987 | Persson | 299/40.1 |
| 5,605,381 | 2/1997 | Schmoock, Jr. et al. | 299/39.2 |

*Primary Examiner*—Robert A. Rose
*Attorney, Agent, or Firm*—Speckman Pauley Petersen & Fejer

[57] ABSTRACT

A motor is disposed above the protective covering or chassis of a movable surface treatment device. Via its vertically arranged power take-off shaft, the motor drives the horizontally extending rotor shafts, on which respectively one rotor cage is disposed on both sides of a gear housing. The rotor shafts are driven in opposite directions, so that one drum mills in the same direction and the other drum mills with opposite horizontal rotary movement. The gear housing is driven in a stepped-down manner via a two-stage transmission by a power take-off pulley disposed on the power take-off shaft. The rotor cages make two superimposed rotary movements. Thus, the treated surface no longer has a grooved appearance, the surface is treated more evenly and better, and finally, no self-driving force acts on the movable surface treatment device. Work safety is thus increased in addition to work quality. One rotor cage is driven in the same direction, the other in the opposite direction with respect to the horizontal rotation, by which the work output is increased and the appearance of shadows is removed.

10 Claims, 2 Drawing Sheets

MOVABLE SURFACE TREATMENT DEVICE

BACKGROUND OF THE INVENTION

1. Field of the Invention

This invention relates to a movable surface treatment device, particularly for the abrasive treatment of surface areas.

2. Description of Prior Art

Movable surface treatment devices, particularly those which are used for cleaning concrete floors or for removing road markings, operate with rotor cages having horizontal cage bars on which a multitude of treatment elements are arranged. The rotor cages are driven by motors, and the device moves along the surface. Small surface treatment machines customarily have only one rotor drum. In spite of the plurality of treatment disks, the worked surface has a clear grooved appearance. Movement of the device is provided by the reaction force of the disks which beat tangentially on the ground.

Larger devices of this type have two rotor cages driven in opposite directions, and the reaction forces from both rotor cages cancel each other out. The desired forward movement is provided by the relative inclination of the rotor cages with respect to each other. Such a device is disclosed in European Patent Publication EP-A-0 098 798.

A smaller surface treatment device is known from European Patent Publication EP-B-0 241 417 and has two rotor cages disposed on rotor shafts.

This device, which essentially represents the prior art, operates with a centrally driven rotor shaft, on which respectively one rotor cage is disposed on either side. The essential advantage of this relatively small device is its excellent application for inside buildings, because of its easy mobility and the optimally used treatment width.

The remaining unprocessed strip between the two rotor cages and the grooves in the worked surface caused by the treatment disks is disadvantageous in connection with the last mentioned device. While the device in accordance with E-PA-098 798 does not leave an unworked strip behind, the grooves remain. It is necessary to remove the grooves with additional work steps, such as grinding or priming, particularly with cleaned concrete floors or decks of ships.

Also, for reasons of safety, a forward reaction movement is no longer desired, even with smaller devices. In spite of warnings by manufacturers, operators permit the device to move uncontrolled while the operators briefly take care of other work.

SUMMARY OF THE INVENTION

It is one object of this invention to create a surface treatment device wherein the above described disadvantages are removed.

This and other objects are attained by a movable surface treatment device having rotor shafts seated in a gear housing which relative to a chassis or protective housing is seated so that it can rotate about a vertical power take-off shaft. According to this invention, one rotor cage is driven in one direction and another rotor cage is driven in a direction opposite the one direction, all with respect to a horizontal. Further advantageous embodiments will be explained in the subsequent description.

One preferred embodiment of this invention is shown in the drawings and will be explained by means of the description.

DESCRIPTION OF PREFERRED EMBODIMENTS

Figure 1:
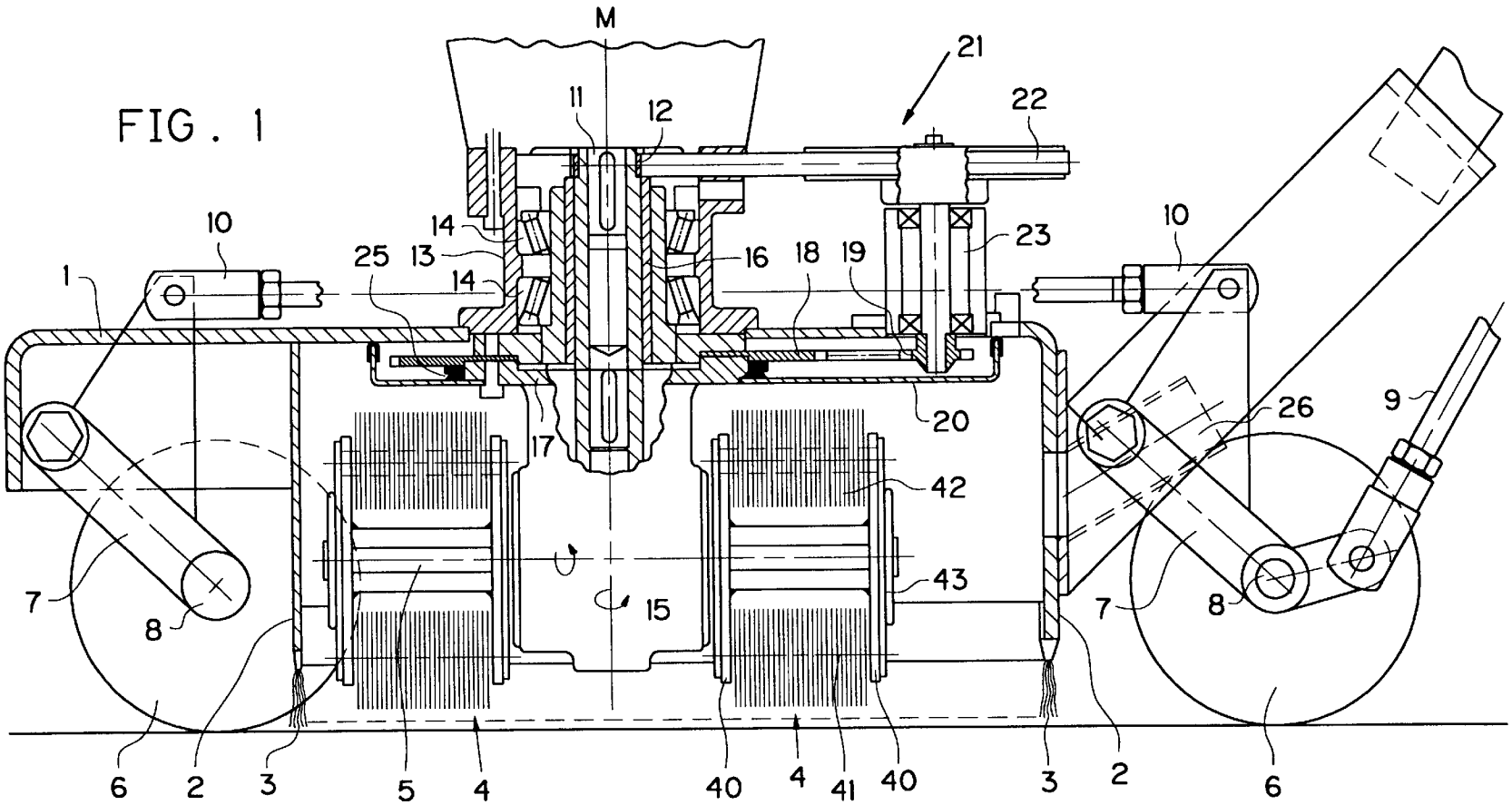
FIG. 1 shows a vertical longitudinal partial section taken through a movable surface treatment device according to one preferred embodiment of this invention.
Figure 2:
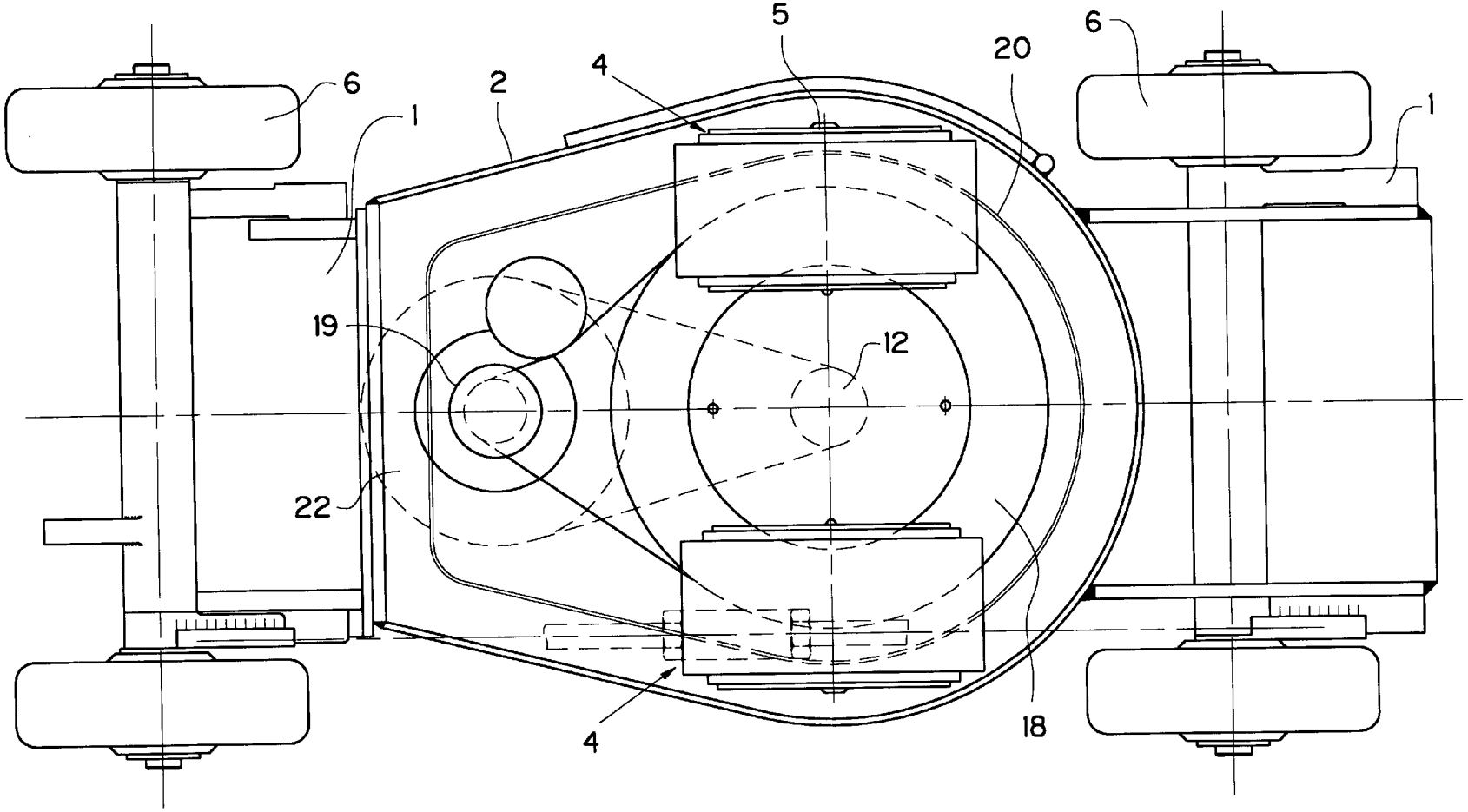
FIG. 2 is a bottom view of the movable surface treatment device shown in FIG. 1.

The movable surface treatment device of this invention comprises a self-supporting protective housing, which is used as the chassis and is identified by reference numeral 1, and a motor M disposed thereon, which drives rotor shafts 5 disposed inside the protective housing 1 via a vertical power take-off shaft 11. The rotor shafts 5 are centrally seated and driven, and the rotor shafts 5 project on both sides out of a gear housing 15. Each rotor shaft 5 is interlockingly and/or frictionally connected with the rotor cages 4. Each rotor cage 4 comprises two lateral cheeks 40, between which cage bars 41 extend, on which freely rotatable abrasive beating treatment disks 42 are lined up. The rotor cages 4 are securely maintained on the rotor shaft 5 by means of a releasable locking device 43. The wheel shafts 8 are fastened on the chassis or protective housing 1 via pivotable arms 7. The wheels are mounted free-wheeling on the wheel shafts 8. The pivot arms 7 are used for relative height adjustment of the protective housing 1 with respect to the surface to be treated. For this purpose the pivotable arms 7 are in operational connection via guides with a connecting bar 10, which causes parallel pivoting of the two wheel shafts 8. Height adjustment is achieved when an operator actuates an actuating rod 9, which acts on one of the two wheel shafts 8 and in this way also on the second wheel shaft 8 via the parallel guide by the connecting bar 10. Thus, it is not necessary for the rotor shafts 5, or the rotor cages 4 disposed thereon, to be height-adjustable with respect to the protective housing 1.

The drive motor M, which is indirectly fastened on the protective housing or the chassis 1, drives the rotor shafts 5 and also causes the gear housing 15 in which the rotor shafts 5 are seated to rotate around a vertical shaft. The drive of the rotor shafts 5 takes place directly via the vertical power take-off shaft 11 of the motor M, which is extended and directly inserted into the gear housing 15. Merely the deflection by 90° by a known bevel gear, for example, takes place in the gear housing 15. Depending on the selection of the bevel gears, a definite step-up or stepdown can take place. The rotor cages 4, also called milling drums or disk drums, customarily operate at speeds of 1500 to 1700 rpm. In this case it is advantageous if the rotor shafts 5 are oppositely driven. In this way one drum operates along with the horizontal rotation and the other opposite to it. This results in increased work output and an improved quality of the milling image without the so-called shadow formation.

Of course, the gear housing 15 in which the rotor shafts 5 are seated cannot and should not rotate at the same speed. Customary rotating speeds of the gear housing 15 are between 50 and 150 rpm. The drive of the gear housing 15, which is basically seated concentrically around the vertical power take-off shaft 11 of the motor M, is provided by an appropriate step-down realized via transmissions. Accordingly, a power take-off pulley is directly mounted, fixed against relative rotation, on the end close to the motor M of the drive shaft 11. A transmission belt, for example a flat or toothed belt, runs over this power take-off pulley. On the other side this belt is conducted over a pulley wheel 22 which is mounted, fixed against relative rotation, on a transmission shaft 23. The transmission shaft 23 is seated in an appropriate bearing and extends through the protective housing 1. This shaft bearing, not further indicated here, is fixedly arranged on the protective housing or chassis 1. A chain wheel or gear wheel 24, for example, is disposed on the end of the transmission shaft 23 opposite the pulley wheel 22. An appropriate chain or gear belt runs over this small chain or gear wheel 24 and transmits the torque of the power take-off wheel 19 to a drive wheel 18. Correspondingly, the drive wheel 18 is also a chain or toothed wheel which is of an appropriate size for achieving the desired step-down. The gear housing 15 is given the desired rotary movement by this drive wheel 18. Thus, the drive of the gear housing 15 takes place in two stages by means of two transmissions, wherein a first transmission 21 is disposed above the protective housing 1 and a second transmission below the protective housing 1. The connection between these two transmissions is represented by the transmission shaft 23 which extends through the protective housing 1. The motor M is disposed by a bushing-like bearing housing 13 above the protective housing 1. The vertical power take-off shaft 11 of the motor M is seated in a concentric hollow shaft having the shape of a bushing 16 with a collar. The previously described drive wheel 18 is frictionally and/or interlockingly maintained between the collar of the bushing 16 and the flange-shaped widening of the gear housing 15. The concentric hollow shaft is seated in the bearing housing 13 by rolling bearings 14, which are capable of bearing radial and axial loads. While the vertical power take-off shaft 11 which extends through the hollow shaft 16 rotates with the rotational speed of the motor in the innermost location, the hollow shaft runs at an appropriate considerably lower speed, which is considerably reduced by means of the double transmission gearing reduction.

The transmission extending below the protective housing 1 therefore is in an area of extensive dust generation. A cover 20 is preferably screwed from below to the protective housing 1 and is appropriately protected against vibrations. The cover 20 is stationary and is appropriately sealed against the rotating flange of the gear housing 15 by means of a sliding seal 25.

For occupational health reasons the entire space in which the rotor cages 4 move, the so-called dust space, is separated from the environment by means of a boundary wall 2. Sealing of the boundary wall 2 is accomplished with a brush seal 3 at the end. The space sealed is thus freed of dust to a large extent by a dust removal device 26, the same as with known devices of the same applicant.

The advantages of the device in accordance with this invention in contrast to known floor treatment devices of the type mentioned at the outset are considerable. The surface is treated considerably more evenly, according to this invention, because of rotary movements imposed one on top of the other. The orientation of beating directed to the surface varies continuously. Grooves therefore are no longer formed. Polydirectional treatment of the surface to be treated removes pores and produces a more even surface. A particularly essential side effect is that no self-driving force on the device by means of the rotating rotor cages 4 is generated during treatment. This means that the device no longer moves by itself if the operator briefly lets go of the device. The danger of work accidents is thus considerably reduced.

Although not shown in the drawings, a further cover could be applied over the chassis or the self-supporting protective housing 1, which would at least protect the transmission 21.

The basic concept of this invention lies in that the rotor cages 4 are given two different rotating movements, namely for one around the horizontal axis in which the rotor shafts 5 extend, as has been customary up to now, and secondly by the superimposed rotating movement around a vertical axis in which the power take-off shaft 11 of the motor extends.

With respect to horizontal rotating movement of the two rotor cages 4, it is important that one rotor cage 4 mills in the direction of movement and the other rotor cage 4 operates oppositely. This demonstrably increases the work output and leads to the lack of shadow formation. Thus, the visual appearance is free of traces of milling which would reveal a rotary or other forward movement.

What is claimed is:

1. In a movable surface treatment device for abrasive treatment of a surface, the device having two rotor cages (4) driven by a motor (M) and arranged on two aligned horizontal rotor shafts (5), on cage bars (41) of the rotor cages (4) a plurality of abrasive beating treatment disks (42) are lined up, a protective housing (1) adjustable to a height of the rotor cages (4) with respect to the ground to be treated, wherein the motor (M) is flanged on and fixed against relative rotation with respect to the protective housing (1), a vertical power take-off shaft (11) driving the horizontal rotor shafts (5) via a gear, the improvement comprising: the rotor shafts (5) seated in a gear housing (15), the gear housing (15) relative to the protective housing (1) seated and rotatable around the vertical power take-off shaft (11), and the gear housing (15) capable of a forced rotating movement by the motor (M) wherein one of the rotor cages (4) is driven in a same direction and another of the rotor cages (4) is driven in an opposite direction with respect to the same direction, in a horizontal rotation; and a power take-off pulley (12) on the vertical power take-off shaft (11) acting in a step-down manner via a first transmission (21) on a belt wheel (22), which is mounted fixed against relative rotation on a transmission shaft (23) and driving the transmission shaft (23) and moving a power take-off wheel (19) fastened on the transmission shaft (23) via a second transmission (18, 19) on the drive wheel (18) connected to and fixed against relative rotation with respect to the gear housing (15).

2. In a movable surface treatment device for abrasive treatment of a surface, the device having two rotor cages (4) driven by a motor (M) and arranged on two aligned horizontal rotor shafts (5), on cage bars (41) of the rotor cages (4) a plurality of abrasive beating treatment disks (42) are lined up, a protective housing (1) adjustable to a height of the rotor cages (4) with respect to the ground to be treated, wherein the motor (M) is flanged on and fixed against relative rotation with respect to the protective housing (1), a vertical power take-off shaft (11) driving the horizontal rotor shafts (5) via a gear, the improvement comprising: the rotor shafts (5) seated in a gear housing (15), the gear housing (15) relative to the protective housing (1) seated and rotatable around the vertical power take-off shaft (11), and the gear housing (15) capable of a forced rotating movement by the motor (M) wherein one of the rotor cages (4) is driven in a same direction and another of the rotor cages (4) is driven in an opposite direction with respect to the same direction, in a horizontal rotation, a power take-off pulley (12) mounted on the power take-off shaft (11) of the motor (M), and the power take-off pulley (12) acting via a step-down transmission (21) on a drive wheel (18) connected to and fixed against relative rotation with respect to the gear housing (15).

3. In a movable surface treatment device in accordance with claim 1, wherein the rotor cages (4) are enclosed by a wall (2) which defines a dust space, the wall (2) is sealed against the ground to be treated by a seal (3), and a dust removal device (26) extends through the wall (2).

4. In a movable surface treatment device in accordance with claim 1, wherein the first transmission (21) is disposed above the protective housing (1) and the second transmission (18, 19) is disposed below the protective housing (1), and the transmission shaft (23) extends through the protective housing (1).

5. In a movable surface treatment device in accordance with claim 4, wherein the second transmission (18, 19) is covered toward an interior of the protective housing (1) by a sealed cover.

6. In a movable surface treatment device for abrasive treatment of a surface, the device having two rotor cages (4) driven by a motor (M) and arranged on two aligned horizontal rotor shafts (5), on cage bars (41) of the rotor cages (4) a plurality of abrasive beating treatment disks (42) are lined up, a protective housing (1) adjustable to a height of the rotor cages (4) with respect to the ground to be treated, wherein the motor (M) is flanged on and fixed against relative rotation with respect to the protective housing (1), a vertical power take-off shaft (11) driving the horizontal rotor shafts (5) via a gear, the improvement comprising: the rotor shafts (5) seated in a gear housing (15), the gear housing (15) relative to the protective housing (1) seated and rotatable around the vertical power take-off shaft (11), and the gear housing (15) capable of a forced rotating movement by the motor (M) wherein one of the rotor cages (4) is driven in a same direction and another of the rotor cages (4) is driven in an opposite direction with respect to the same direction, in a horizontal rotation, the drive motor (M) flanged to a bearing housing (13) through which the vertical power take-off shaft (11) of the motor (M) extends, and the bearing housing (13) connected with the protective housing (1).

7. In a movable surface treatment device in accordance with claim 1, wherein a bushing (16) is fastened on the vertical power take-off shaft (11) of the motor (M), which has a collar on an end to which the gear housing (15) is screwed.

8. In a movable surface treatment device in accordance with claim 7, wherein the bushing (16) extends through a bearing housing (13) and is seated radially and axially within the bearing housing (13).

9. In a movable surface treatment device in accordance with claim 1, wherein a plurality of wheel shafts (8) are hinged pivotally in parallel on the protective housing (1).

10. In a movable surface treatment device in accordance with claim 1, wherein the two horizontal rotor shafts (5) are driven in opposite directions.

* * * * *